United States Patent [19]

Sweet

[11] 4,359,383

[45] Nov. 16, 1982

[54] PLACER MINING APPARATUS

[76] Inventor: Dale F. Sweet, P.O. Box 757, Chandler, Ariz. 85224

[21] Appl. No.: 180,848

[22] Filed: Aug. 25, 1980

[51] Int. Cl.[3] ..... B07B 7/00

[52] U.S. Cl. ..... 209/479; 209/489; 209/502; 209/250; 209/437; 406/62; 209/44; 209/64

[58] Field of Search ..... 209/479–481, 209/488, 489, 497–499, 502, 250, 160, 437, 447, 506, 44, 64; 299/91, 11; 406/62; 91/5, 6, 234, 161; 366/124; 210/388, 389

[56] References Cited

U.S. PATENT DOCUMENTS

| | | | |
|---|---|---|---|
| 747,692 | 12/1903 | Francois | 209/64 X |
| 1,041,428 | 10/1912 | Christine | 209/502 X |
| 1,240,396 | 9/1917 | Winchester | 209/437 X |
| 2,101,295 | 12/1937 | Rusk | 209/502 X |
| 2,208,141 | 7/1940 | Traylon | 209/437 |
| 2,513,603 | 7/1950 | Utley | 209/499 X |
| 2,828,925 | 3/1958 | Acheson | 15/382 X |
| 2,872,902 | 2/1959 | Moroan | 91/6 X |
| 3,023,738 | 3/1962 | Burgess | 91/234 |
| 3,116,237 | 12/1963 | Fontein | 209/489 X |
| 3,667,814 | 6/1972 | Krivda | 406/62 |
| 3,724,661 | 4/1973 | Gohatti | 209/437 |
| 3,799,415 | 3/1974 | Tidd | 209/506 X |
| 3,804,245 | 4/1974 | Pendleton | 209/250 |
| 3,874,732 | 4/1975 | Krivda | 55/356 X |
| 3,910,837 | 10/1975 | Good | 209/488 X |
| 3,915,436 | 10/1975 | Matson | 269/22 X |
| 3,941,690 | 3/1976 | Powers | 209/44 |
| 4,028,231 | 6/1977 | Parker | 209/497 |
| 4,055,251 | 10/1977 | Pieton | 209/38 |
| 4,082,657 | 4/1978 | Gage | 209/405 |
| 4,101,419 | 7/1978 | Bergman | 209/160 |

*Primary Examiner*—Norman Yudkoff
*Attorney, Agent, or Firm*—Don J. Flickinger

[57] ABSTRACT

A portable, dry-placer mining apparatus is provided with a vacuum chamber which defines a contained region of lower-than-atmospheric pressure which establishes the mode or means for drawing material into the chamber. The material is then ejected therefrom at a rate determined by the differential pressures established internal and external to the vacuum chamber. To prevent material impaction from interferring with the vacuum controlled output flow of material, any tendency of the material toward impaction is disrupted by an air stream flowing therethrough in response to the lowered pressure within the vacuum chamber. The material is output to a vacuum controlled separator device which is vibrated to separate denser from less-dense materials. A vacuum responsive frequency control is incorporated in the vacuum responsive vibratory drive of the separator device. The entire device is easily manually transportable and may be fitted to a conventional backpack frame.

26 Claims, 7 Drawing Figures

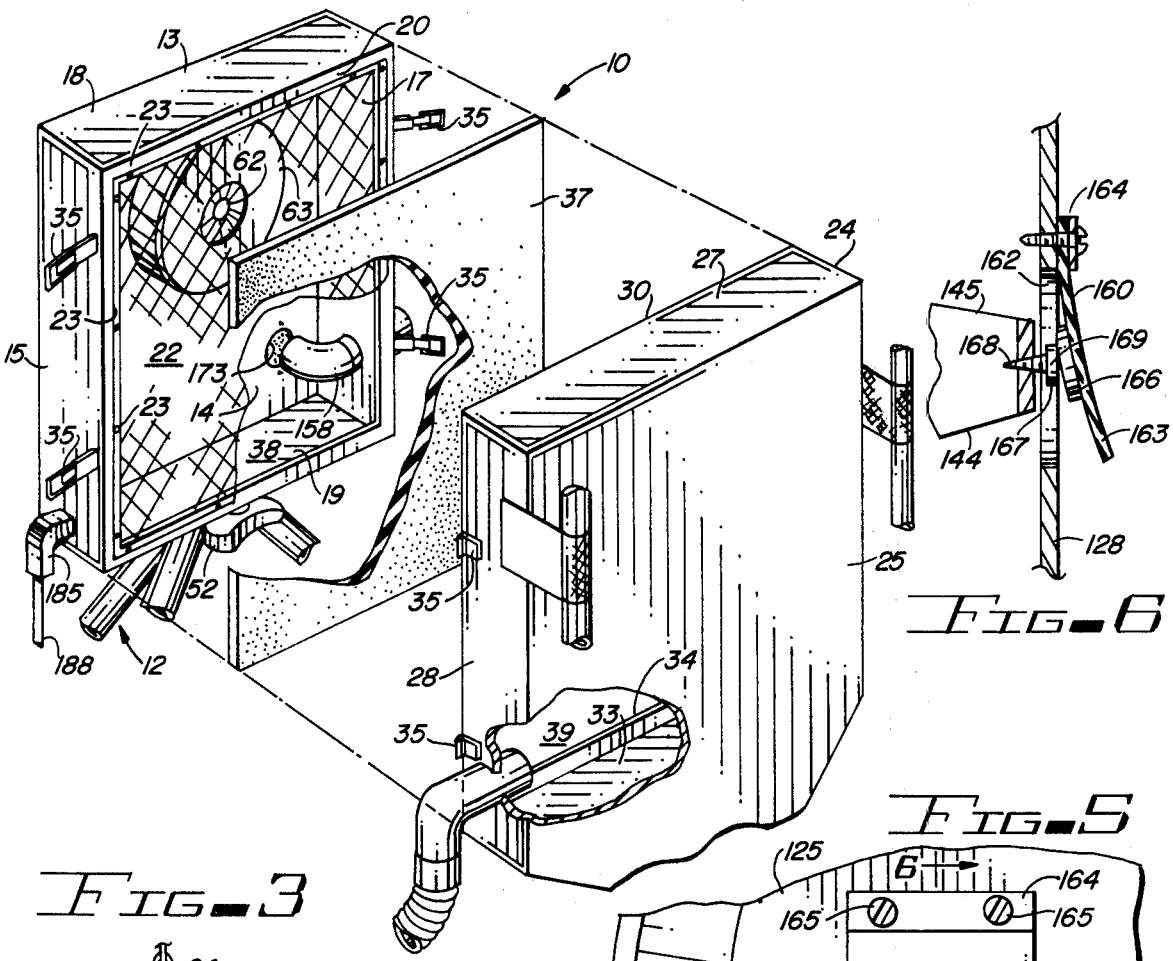
FIG. 6
FIG. 3
FIG. 5
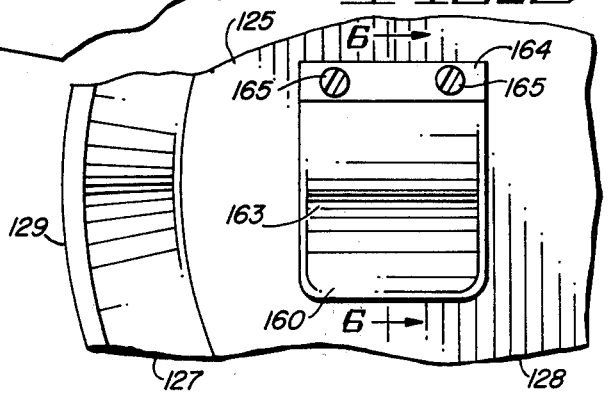
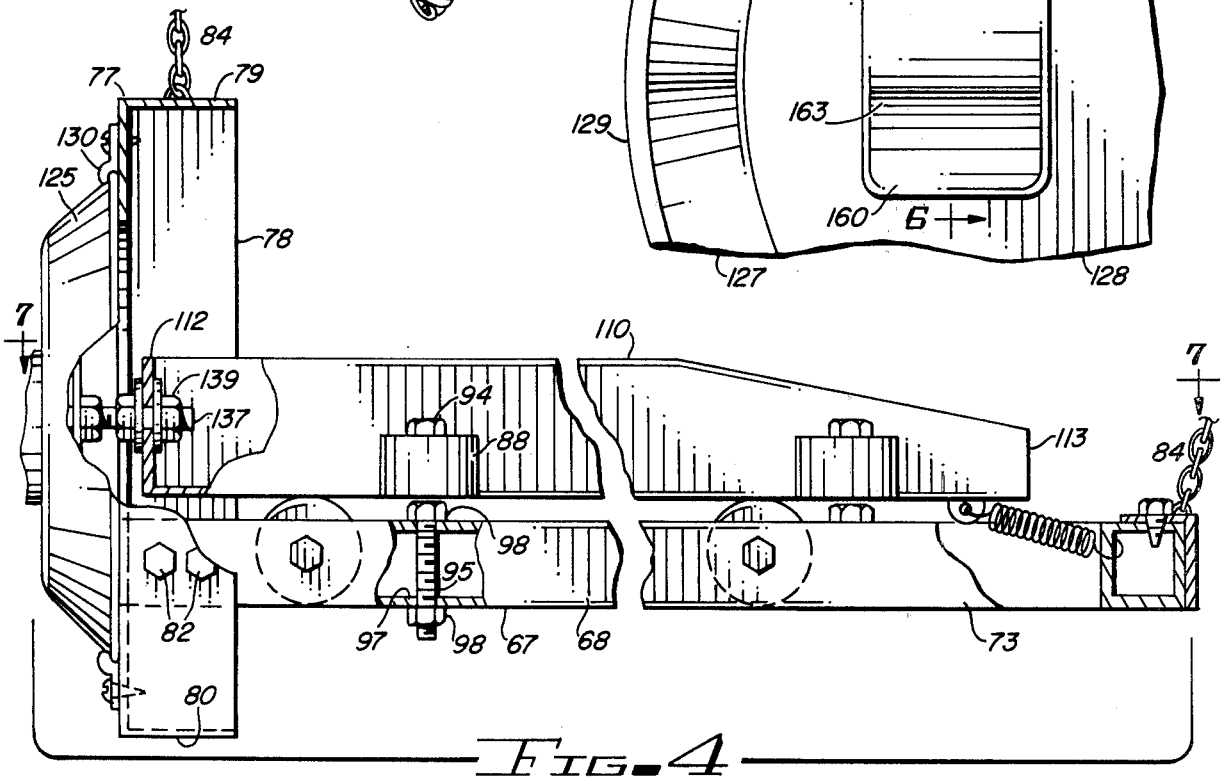
FIG. 4

PLACER MINING APPARATUS

FIELD OF THE INVENTION

This invention relates to mining apparatus.

In a further aspect, the present invention relates to placer mining apparatus.

More particularly, the instant invention concerns a placer mining apparatus having vacuum actuated excavation and separation means.

PRIOR ART

Placer mining, processing granular material to recover gold and other precious minerals, is an old and well known art. Traditionally, the procedure involves the use of an elongate trough provided with a plurality of spaced transverse obstacles, known as riffles. Commonly referred to as a sluice, the trough is generally inclined having the feed end elevated above the discharge end.

The hopefully auriferous material, a mixture of loose gravel, sand and dirt usually from in or adjacent a streambed, is scooped up and placed at the feed end of the sluice. As the material is washed along the sluice by a stream of moving water, the heavier minerals settle out and remain within the compartments between the riffles. The lighter material, tailings, moves over the riffles from compartment to compartment, and along with the water, leaves the discharge end of the sluice.

The prior art has provided various innovations in an attempt to improve the art of placer mining. A search, conducted within the U.S. Patent and Trademark Office to determine relevant prior art, revealed the following issued U.S. Pat. Nos.:

747,692: Francois
3,910,837: Good
3,874,732: Krivda
2,872,902: Morgan
2,208,141: Traylor
1,240,396: Winchester
3,724,661: Gobatti
3,667,814: Krivda
3,915,436: Matson
2,101,295: Rusk
2,513,603: Utley Disclosed in U.S. Pat. No. 2,208,141, is a concentrating table having channel means, such as grooves or riffles, extending radially from a sump at the lower end thereof. The table is agitated in response to a vibrating mechanism including an unbalanced wheel.

Generally analogous devices, including structure alternate to conventional riffles and eccentric crank mechanisms for agitation, are disclosed in U.S. Pat. Nos. 747,692; 1,240,396 and 3,724,661.

U.S. Pat. No. 3,910,837 discloses a portable placer mining apparatus of the surface dredge type. In response to a floatable motor driven pump, pebbles, silt and water from the bottom of a stream are drawn through a flexible hose and discharged into a sluice box. The sluice box includes a plurality of radially arranged riffle rods and a removable cover plate. Means are provided for directing water flow and for creating back pressure to the flow of water. Vacuum actuated apparatus for the transfer of dry particulate material are disclosed in U.S. Pat. Nos. 3,667,814 and 3,874,732.

The movable bed pneumatic stratifier disclosed in U.S. Pat. No. 2,513,603 includes a table or classifier reciprocately mounted within a housing. The classifier is vibrated in response to manual crank means which concurrently operates a blower.

U.S. Pat. No. 2,101,295 discloses apparatus for air floatation separation in which an upperly directed draft of air is employed to hold sand in suspension while heavier minerals or particles settle out.

The prior art has, however, failed to provide an adequate solution to certain problems of long standing. Especially neglected is the need for an effective device for placer mining in dry stream beds and similar normally arid sites.

Accordingly, it is an object of the present invention to provide improved mining apparatus for the recovery of precious minerals from dry granular material.

Another object of the invention is to provide an apparatus which will simultaneously and automatically perform the various functions of placer mining.

And another object of the invention is the provision of a complete self-contained placer mining apparatus.

Still another object of this invention is to provide a placer mining apparatus having vibrating means for the separation of precious metals from gravel, sand, dirt, etc.

Yet another object of the invention is the provision of a placer mining apparatus including conveyor means for excavating auriferous material and delivering said material to the separator means.

Yet still another object of the instant invention is to provide a placer mining apparatus in which the separator means and the conveyor means are driven by a single vacuum source.

And a further object of the invention is the provision of a placer mining apparatus having means for excavating gold or other minerals from crevices or other obscured locations.

Still a further object of the invention is to provide placer mining apparatus including means for controlling the rate of delivery of the auriferous material to the separator.

And a further object of the invention is the provision of a placer mining apparatus which can be effectively utilized by a single operator.

Yet still a further object of the invention is to provide a placer mining apparatus of the above type which is transportable as a backpack unit.

SUMMARY OF THE INVENTION

Briefly, to achieve the desired objects of the instant invention, in accordance with a preferred embodiment thereof, provided is vacuum means for generating a vacuum. Separator means, operative in response to the vacuum, receives granular material bearing particles of various densities and separates the denser particles from the less dense particles. Conveyor means, also operative in response to the vacuum, excavates the auriferous material and delivers same to the separator means. The device may be supported by a foldable frame and adapted for backpack carrying.

In accordance with a more specific embodiment of the invention, the vacuum means includes a chamber supported in an elevated position by the frame. A motor driven blower creates a vacuum within the chamber. A subframe, carrying a reciprocally mounted trough having a plurality of transverse riffles, is supported by the main frame at a position below the vacuum chamber. Vacuum actuated means, carried by the subframe and communicating with the vacuum chamber, imparts vibration to the trough.

The conveyor means includes an elongate flexible conduit for drawing in granular material and delivering same to the upper end of an upright drop tube. A valve at the lower end of the drop tube, normally closed by the vacuum, controls the flow of granular material from the drop tube to the trough. Means are also provided to prevent the granular material from becoming impacted within the drop tube.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 3 is an enlarged exploded perspective view of the upper portion of the device of FIG. 1, portions thereof being broken away for purposes of illustration;

FIG. 4 is an enlarged fragmentary side elevation view of the lower portion of the device of FIG. 1, portions thereof being broken away for purposes of illustration;

FIG. 5 is an enlarged fragmentary elevation view taken from the left-hand end of the illustration of FIG. 4;

FIG. 6 is a vertical sectional view taken along the line 6—6 of FIG. 5.

DESCRIPTION OF THE PREFERRED EMBODIMENTS

Figure 1:
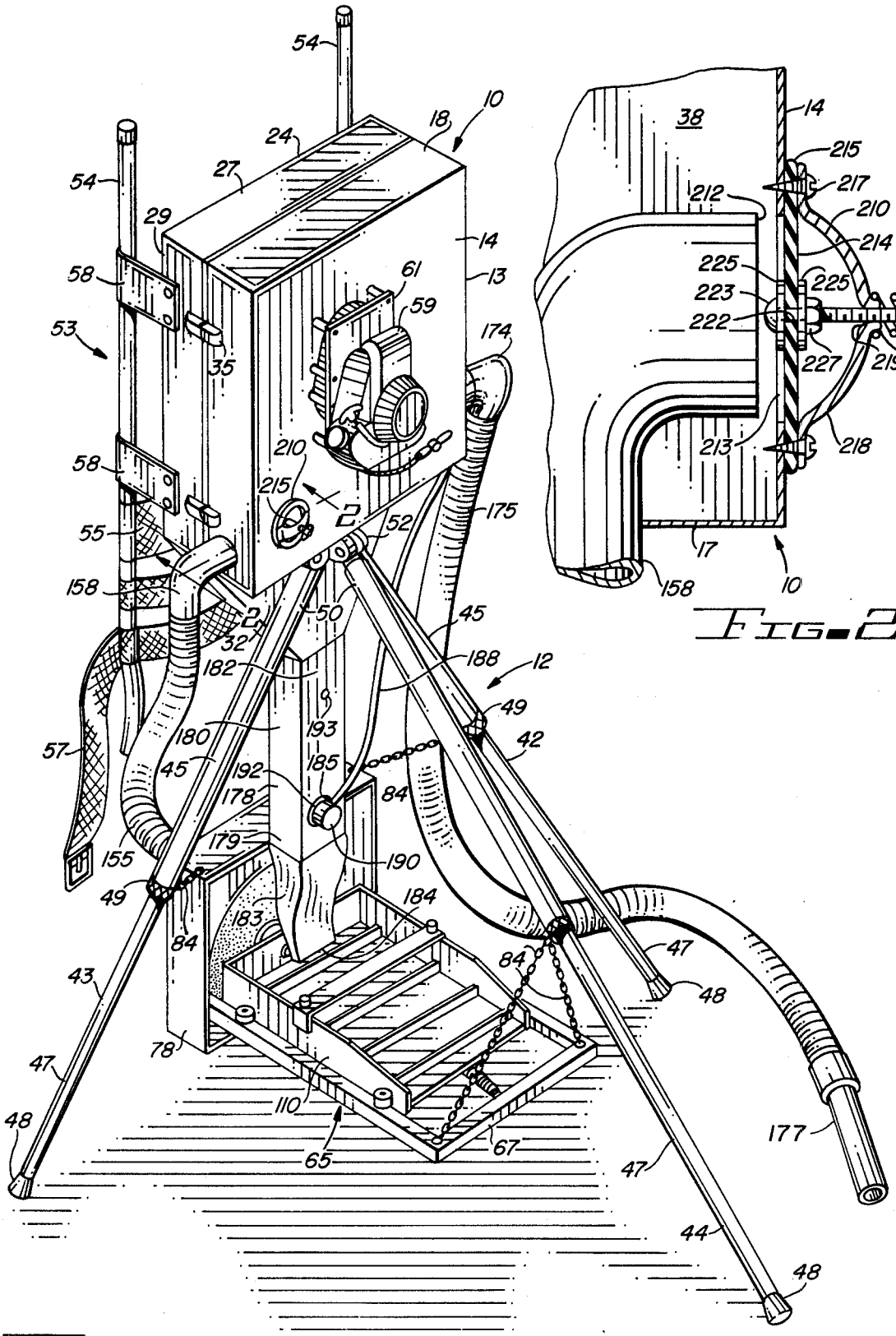
FIG. 1 is a perspective view of a placer mining apparatus constructed in accordance with the teachings of the instant invention.

Turning now to the drawings in which like reference characters indicate corresponding elements throughout the several views, attention is first directed to FIG. 1 which illustrates a cabinet supported by a frame, generally designated by the reference characters 10 and 12, respectively. Cabinet 10, as further viewed in FIG. 3, includes box-like base section 13 having end wall 14 from which extends first side panel 15, second side panel 17, top panel 18 and bottom panel 19. The several panels terminate with a continuous lip 20 to which is removably secured screen 22 as by screws 23.

Cabinet 10 further includes a cover section 24 having end wall 25 from which extends top panel 27 and first and second side panels 28 and 29, respectively. The several panels 27, 28 and 29 terminate with continuous edge 30. Residing at the lower portion of cover section 24 is a downwardly convergent squared funnel 32 formed by extending end wall 25 and side walls 28 and 29 and adding front panel 33. The upper edge 34 of panel 33 is continuous with edge 30.

Cover section 24 is detachably securable to base section 13 by conventional two-piece toggle clasps 35. In the assembled position, filter element 37, readily fabricated of readily available material as will be suitably selected by those skilled in the art, is clamped between edges 20 and 30. Screen 22, preferably hardware cloth, supports filter element 37 and prevents movement thereof in a direction toward end wall 14 as will be further clarified presently. The space within cabinet 10 is subdivided by filter element 37 into a first chamber 38 within base section 13 and a second chamber 39 within cover section 24.

Frame 12, being of the tripod type, includes laterally extending legs 42 and 43 and forwardly extending leg 44. Being identical, each leg 42, 43 and 44 includes an upper section 45 and a telescopingly extendable lower section 47 terminating with foot 48. The adjustable length of each leg, the movement of lower section 47 relative to upper section 45, is controlled by knurled locking collar 49 in accordance with conventional practice. The upper end 50 of each upper section 45 is pivotally connected to bracket 52 secured to the under side of bottom panel 19 of base section 13.

With further reference to FIG. 1, there is seen a conventional backpack frame, generally designated by the reference character 53, having the usual upright rails 54, webbing 55 and body attachment straps 57. Backpack frame 53 is affixed to cover section 24 of cabinet 10 by brackets 58 extending between side panels 28 and 29 and the respective upright rails 54 and affixed by rivets or other conventional fastening means.

A conventional internal combustion engine 59, either two or four cycle operation of the type commonly used for small appliances such as lawn edgers, is secured to the outside of end wall 14 by mounting bracket 61. The attachment, operation and use of an engine of the type illustrated is well known and will be immediately appreciated by those skilled in the art. Drive shaft 62 from engine 59 extends through end wall 14 into first chamber 38. A conventional blower 63, having a size chosen in accordance with the power output of engine 59, is affixed to drive shaft 62 within chamber 38. In accordance with an alternate embodiment of the invention, blower 63 may be mounted upon a shaft or stub axle rotatably carried by mounting bracket 61 and driven by engine 59 through conventional belt or gearing means.

Blower 63, operative in response to engine 59, creates an air flow in a direction passing inwardly through filter element 37 and exhausting through an opening (not specifically herein illustrated) through end wall 14 concentric with shaft 62. Chamber 38 functions as the vacuum chamber or the vacuum means, further including engine 59 and blower 63, for generating a vacuum for operation on other components of the instant invention as will be described presently.

Figure 7:
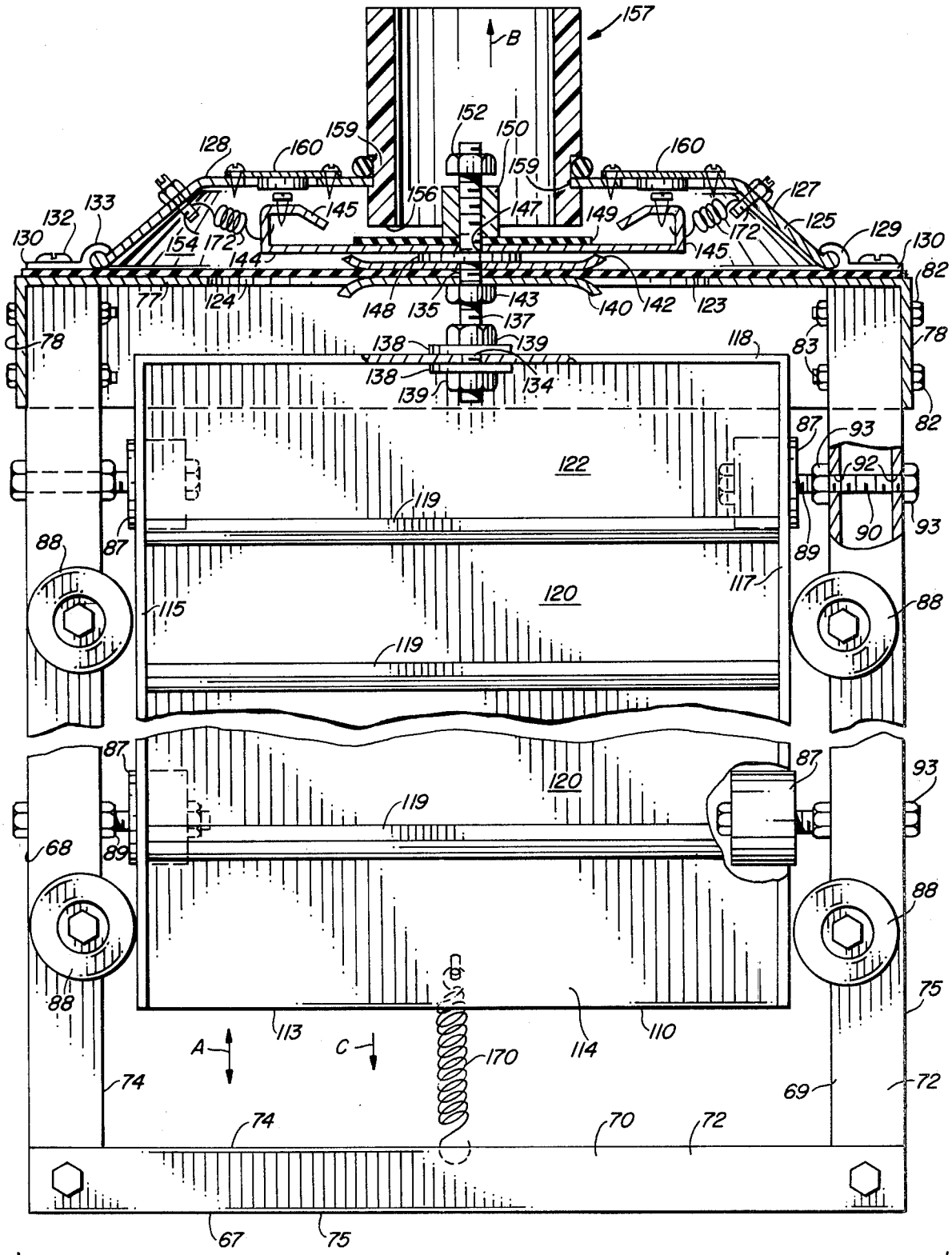
FIG. 7 is an enlarged fragmentary horizontal sectional view taken along the line 7—7 of FIG. 4.

Separation means, generally designated by the reference character 65, for the separation of precious minerals, such as gold, from granular material, such as a mixture of gravel, sand and dirt, is carried by frame 12 at a position below cabinet 10. With particular reference to FIGS. 1, 4 and 7, it is seen that separation means 65 includes rectangular frame 67 having longitudinally extending side rails 68 and 69 and transverse forward end rail 70. Preferably, each rail 68, 69 and 70 is fabricated from box section metallic stock having upper and lower horizontal sides 72 and 73, respectively, and inner and outer vertical sides 74 and 75, respectively. Rails 68, 69 and 70 may also be fabricated from angle section stock to decrease weight.

Subframe 67 further includes upright plate 77 having forwardly directed side flanges 78, top flange 79 and bottom flange 80. Plate 77 abuts the rearward ends of side rails 68 and 69 with side flanges 78 adjacent the outer vertical sides 75 of respective side rails 69 and 69. Bolts 82 extend through the side flanges 78 and the respective side rails 68 and 69 and are engaged with nuts 83. Subframe 67 is detachably suspended from frame 12 by a plurality of chains 84 in accordance with conventional practice.

Two guide rollers 87, rotatable about a horizontal axis, and two rollers 88, rotatable about a vertical axis, are carried by each side rail 68 and 69. Each roller 87, extending inwardly from the respective side rail, is rotatably carried by a shank 89 having threaded portion 90 extending through apertures 92 in vertical side 74 and 75 and secured thereto by nuts 93. Similarly, each roller 88 is supported above the respective side rail by a shank 94 having threaded section 95 extending through apertures 97 in horizontal side 72 and 73 and secured thereto by nuts 98. A sluice trough 110 having rear or feed end 112 and front or discharge end 113 is carried by subframe 67. Sluice trough 110 is generally box-shaped having upright sidewalls 115 and 117 and rear end wall 118. A plurality of transverse riffles 119 upstanding from deck 114, extend between sidewalls 115 and 117. The several riffles 119 are spaced apart to form compartments 120 therebetween and compartment 122 between rear end wall 118 and the adjacent riffle 119. Sluice trough 110 is reciprocally movable relative frame 67 in directions indicated by the double arrowed line A, deck 114 bearing upon rollers 87 and sidewalls 115 and 117 being guided by the respective rollers 88.

Vibratory means, operative in response to the vacuum means, for imparting reciprocal motion to sluice trough 110 is carried by upright plate 77. As seen in FIG. 7, an opening 123 is formed through plate 77. Positioned against plate 77 and extending across opening 123 is fluid impervious flexible diaphragm 124 held in place by cover 125. Being generally frustoconical, cover 125 includes rearwardly convergent sidewall 127 extending between end panel 128 and beaded edge 129. Spaced around cover 125 are a plurality of clips 130 secured to plate 77 by screws 132. Each clip 130 includes a hook-shaped lip 133 engaged over beaded edge 129 and urging beaded edge 129 toard plate 77. Accordingly, diaphragm 124 is held in place and functions as a gasket to form an air-tight seal between plate 77 and cover 125. To equalize tension about diaphragm 124 during movement, as will be described presently, beaded edge 129 is concentric with opening 123.

Apertures 134 and 135 extend through end wall 118 of sluice trough 110 and diaphragm 124, respectively, along the central axis of opening 123. Threaded shaft 137, extending through apertures 134 and 135, is secured to end wall 118 by washers 138 and nuts 139. A pair of dished washers 140 and 142, receiving shaft 137 therethrough, are placed on opposite sides of diaphragm 124. Washer 140, placed on the front of sluice trough facing side of diaphragm 124, is abuted by nut 143 threadedly engaged with shaft 137 and generally similar to previously described nuts 139.

Valve actuating bar 144 having inturned U-shaped ends 145 and residing within cover 125, has a centrally located aperture 147 through which passes shaft 137. Plain washer 148, brazed or otherwise affixed to shaft 137, resides intermediate dished shaped washer 142 and bar 144. Nut 143 opposes washer 148 clamping diaphragm 124 between washers 140 and 142 and forming an airtight seal.

Gasket 149 is bonded to bar 144. Spacer 150 and bar 144 are slidably disposed upon shaft 137. Nut 152, threadedly engaged with shaft 137, retains bar 144 and spacer 150 upon shaft 137. Bar 144 and spacer 150 are free to move upon shaft 137 between limits defined by washer 148 and nut 152.

Air-tight chamber 154 is formed within cover 125. Flexible hose 155, having rigid tubular fittings 157 and 158 at the ends thereof, communicates between air-tight chamber 154 and vacuum chamber 38. Fitting 157, having end 156, extends through opening 159 in end panel 128 of cover 125 and is secured thereto with an air-tight seal in accordance with conventional practice. In response to the vacuum within chamber 38, as previously described, chamber 154 is evacuated. In response to the pressure differential on opposite sides, diaphragm 124 moves in the direction of arrowed line B resulting in a similar movement of sluice trough 110.

End 156 of fitting 157 and gasket 149 form a valve which is closable to discontinue communication between vacuum chamber 38 and chamber 154. Concurrent with the movement of sluice trough 110, bar 114 and diaphragm 124 also move in the direction of arrowed line B closing the valve formed by gasket 149 and end 156. Simultaneous with the discontinuance of vacuum to chamber 154, the vacuum within chamber 154 is exhausted or vented to atmosphere by means of valve 160.

Each valve 160, as further seen in FIGS. 5 and 6, includes an opening 162 through end panel 128 normally closed by reed or flapper member 163. Flapper member 163, such as may be fabricated of thin, flexible metal, is secured to the external side of panel 128 by reinforcing bar 164 and screw 165. In response to the inherent flexibility of the material of construction and the vacuum within chamber 154, flapper members 163 are normally held in air-tight engagement against the surface of panel 128. A resilient pad 166 is secured, as by suitable adhesive, to the internal side of each flapper member 163.

Each valve 160 further includes actuating element 167 having shank 168 threadedly engaged with the hooked-shaped ends 145 of valve actuating bar 144 and carrying head 169. As diaphragm 124, along with sluice trough 110 and valve actuating bar 144, moves in a direction of arrowed line B, heads 169 abut the respective resilient pads 166 to unseat the respective flapper elements 163. As previously noted, flapper elements 163 are unseated coincident with the seating of gasket 149 against end 156. Movement of sluice trough 10 in the direction of arrowed line B is opposed by tension spring 170 extending between discharge end 133 of sluice trough 110 and traverse forward end rail 70. Accordingly, as flapper members 163 are opened, venting chamber 154 to atmosphere, spring 170 urges sluice trough 110 and diaphragm 124 in the direction of arrowed line C.

Free play exists between the movement of sluice trough 110 in the direction of arrowed line C and the restoration of vacuum to chamber 154. At the limit of movement in the direction of arrowed line B, during which valves 160 are opened and the valve formed by gasket 149 and end 156 are closed, washer 148 is abuted against valve actuating bar 144. A space, corresponding to the amount of free play, exists between spacer 150 and nut 152. During the initial movement of sluice trough 110, diaphragm 124 and shaft 137 in the direction of arrowed line C, valve actuating bar 144 remains stationary due to the open position of valves 160 and to gasket 149 being drawn against end 156. At the end of the initial phase of movement, nut 152 is drawn against spacer 150 which in turn abuts gasket 159. Continued movement in the direction of arrowed line C in response to spring 170 urges valve actuating bar 144 in the direction of arrowed line C unseating gasket 149 from end 156 and withdrawing actuating elements 167 allowing flapper elements 163 to assume the closed position. Presently, vacuum is again restored to chamber 154 exerting a pull upon diaphragm 124 and movement in the direction of arrowed line B as initiated.

It is seen, therefore, that sluice trough 10 is caused to vibrate, reciprocal movement in the alternate directions indicated by the arrowed lines B and C, continuously for such a period as vacuum is drawn within flexible hose 155. A coil spring, of relatively light tension, extends between each hook-shaped end 145 and side wall 127 of cover 125. Springs 172 orient valve actuating bar 144 and maintain actuating elements 167 in alignment with pads 166.

Chamber 39, within cabinet 10, is an integral part of the conveyor means of the instant invention for transferring granular auriferous material, stones, sand and dirt, from the placer to the feed end 112 of sluice trough 110. Tubular fitting 174, integral with one end of flexible hose 175, is sealingly secured by conventional means to end panel 28 for communication of hose 175 with chamber 39. At the other end, hose 175 is provided with a rigid nozzle 177 which is passed over the selected place. In response to vacuum drawn through hose 175, granular material enters through nozzle 177, is lifted through hose 175 and deposited in the lower portion of chamber 39. Due to filter 37, dirt and other fine particulate matter is restrained from entering chamber 38 thereby preventing damage or erosion to blower 63, engine 59, diaphragm 124, valves 160 and associated elements.

Upright drop tube 178 having lower end 179 depends from cover section 24 of cabinet 10. Being generally rectangular in cross-section, drop tube 178 includes a pair of spaced apart side panels 180, a front panel 182 and a rear panel not herein specifically illustrated. For purposes of discussion, squared funnel 32 is considered to be the lower portion of chamber 39 and concurrently, the upper portion of drop tube 178. Flexible sleeve 183 converging to a normally open slit 184 at the lower end thereof spaced above compartment 122 is secured to the lower end 179 of drop tube 178.

A fitting 185, as seen in FIG. 1, is affixed to front panel 182 of drop tube 178. Another tubing fitting 187, as illustrated in FIG. 3, is secured to panel 5 of cabinet 10. Flexible tube 188, secured at respective ends to fittings 185 and 187, communicates between the interior of drop tube 178 and chamber 38. Fitting 185 is secured to drop tube 178 by screw 190. Filter 192, clamped between fitting 185 and panel 182, prevents the transfer of granular material from drop tube 178 to chamber 38. Drop tube 178 is vented by aperture 193, intermediate squared funnel 32 and the location of attachment of fitting 185.

Flexible sleeve 183 functions as a check valve. In response to the vacuum drawn in drop tube 178 in response to the vacuum in chamber 38, sleeve 183 is collapsed holding the slit at lower end 179 in a normally closed position. Auriferous material drawn upwardly through flexible hose 175 and presented to squared funnel 32, descends through drop tube 178 coming to rest against sleeve 183. As the material accumulates, the vacuum holding slitted end 184 in the closed position, is decreased. In response to the continued decrease of vacuum and the increased weight of the granular material, slitted end 184 is forced open allowing the gravity discharge of material to the feed end of sluice trough 110. As material falls, the vacuum within sleeve 183 is increased and the weight of the material bearing against slitted end 184 is decreased thereby causing slitted end 184 to again close.

For the duration that granular material is drawn through flexible hose 175, the check valve action of flexible sleeve 183, as described above, periodically cycles. During each cycle, a predetermined quantity of material is delivered to sluice trough 110. The quantity and rate of delivery of material is predetermined by the vacuum within drop tube 178 to coincide with the rate at which said material can be effectively handled by sluice trough 110.

Observation of the operation of a prototype placer mining apparatus constructed in accordance with the teachings of the instant invention, reveals that certain types of granular material exhibiting cohesive characteristics, tend to become impacted within squared funnel 32. The material presents an obstruction which discontinues vacuum to sleeve 183 causing slitted end 184 to remain in the open position. Resultingly, two undesirable phenomena occur. First, large chunks of material breaking off from the impacted mass fall directly onto sluice trough 110. Secondly, continued increase of the impacted material will result in an over accumulation of material within chamber 39 thereby stopping the intended function of the machine.

Air vent 193 and flexible tubing 188 alleviate the foregoing problem with cohesive material without disturbing the function of the machine when used with less cohesive material as previously described. Air, drawn inwardly through vent 193 and upwardly toward cabinet 10 in response to the vacuum within chambers 38 and 39, constantly agitates the material within squared funnel 32 thereby preventing impaction. Tube 188 equalizes the vacuum between chamber 39 and the lower end of drop tube 178, in the proximity of flexible sleeve 183. Accordingly, ample vacuum is supplied to normally hold slitted end 184 in the closed position without consideration of the density of material thereabove either in drop tube 178 or squared funnel 32.

The cyclic rate at which sluice trough 110 is caused to vibrate, is in direct proportion to the vacuum available to hose 155. It is apparent from the foregoing detailed description of the transfer of granular material between nozzle 177 and sluice trough 110, that the vacuum is subject to substantial variation. It is desirable, however, that sluice trough 110 operate at a relatively constant rate for optimum efficiency. In experiments, a vibration rate of 3,000 strokes per minute has been found to yield satisfactory results.

Figure 2:
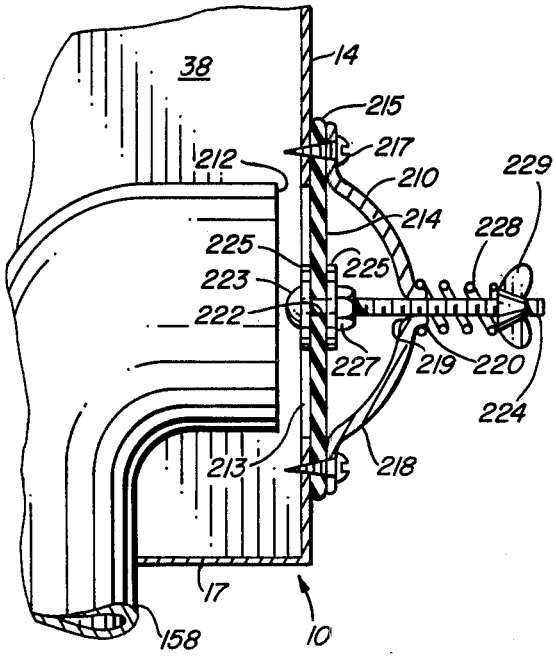
FIG. 2 is an enlarged fragmentary horizontal sectional view taken along the line 2—2 of FIG. 1.

To maintain a substantially uniform cyclic rate of sluice trough 110, placer mining apparatus of the instant invention is provided with a regulator 210 which functions automatically and is manually adjustable. With particular reference to FIG. 2, it is seen that the end 212 of fitting 158 terminates in close parallel relationship with end wall 14 of cabinet 10. An opening 213 is formed through end wall 14 in alignment with end 212. Diaphragm 214 extends across opening 213 and is secured to the external side of wall 14 by ring 215 and screws 217. Bar 218, extending diametrically across ring 215, includes central opening 219 and outwardly projecting boss 220. Boss 220 may be created as the result of forming opening 219 by punching from the side opposite the boss.

Opening 222 extends through diaphragm 214 at a location approximately coaxial with opening 213 and in alignment with opening 219. Bolt 223 having shank 224 extends through opening 222 and is secured thereto by washers 225, one positioned on either side of diaphragm 214 and nut 227. Shank 224 further extends through opening 219 and is of substantial length to extend beyond bar 218 and through compressing spring 228. One end of spring 228 encircles boss 220 for alignment purposes. Wing nut 229, threadedly engaging shank 224, opposes bar 128 retaining spring 228 in compression therebetween.

The vacuum within chamber 38 tends to draw diaphragm 214 inwardly toward end 212 of fitting 158. Spring 228 urges diaphragm 214 externally or in a direction away from end 212. Sluice trough 10 vibrates at the desired rate in response to a nominal vacuum level within chamber 38. As previously described, within vacuum chamber 38 is variable in response to the transfer of granular material by the conveyor means of the placer mining apparatus of the instant invention. In response to increased vacuum within chamber 38, diaphragm 214 is drawn inwardly compressing spring 228 and partially closing the opening at end 212 thereby decreasing the vacuum within hose 115. In response to decreased vacuum within chamber 38, diaphragm 214 is urged outwardly by spring 228, increasing the opening at end 212 and increasing the vacuum level within hose 155. Accordingly, a nominal vacuum level is maintained within hose 155 resulting in sluice trough 110 operating within a desirable vibration range. The nominal vacuum level within hose 155 is manually adjustable by rotating wing nut 229 thereby increasing or decreasing the tension of spring 228.

The materials of certain elements of the placer mining apparatus previously described are predetermined in accordance with manufacturer's specifications of materials suitable for the purpose. For example, flexible hoses of the type designated by the reference characters 155 and 175 and the fittings associated therewith are normally produced from various plastics. Straps, such as strap 57 associated with backpack frame 53, are normally woven cloth. Lightweight internal combustion engines of the type described include various ferrous and nonferrous metals. Substantially, all of the other components of the apparatus, including cabinet 10, frame 12, drop tube 178, subframe 67 and sluice trough 10 are fabricated of relatively lightweight materials such as aluminum. Molded plastic is also suitable for the purpose. Accordingly, there is produced an extremely lightweight, self-contained, portable unit which is easily carried as a backpack unit by a single person.

For this purpose, the apparatus is optionally provided with an integral backpack frame 53. After subframe 67 is removed from main frame 12, each leg 42, 42 and 44 is collapsed, lower section 47 being retracted within the respective upper section 45. The several legs are then folded against drop tube 178 and secured by a suitable binding, such as a rope or strap. Hose 185 is coiled and placed within cabinet 10. Separation means 65 is lashed against cabinet 10.

What has been disclosed is a portable, dry-placer mining apparatus. A vacuum chamber is provided which defines a contained region of lower-than-atmospheric pressure. This vacuum chamber provides the mode or means for drawing material into it, which material is then ejected therefrom at a rate determined by the differential pressures established internal and external to the vacuum chamber. To prevent material impaction from interferring with the vacuum controlled output flow of material, any tendency of the material toward impaction is disrupted by an air stream flowing therethrough in response to the lowered pressure within the vacuum chamber. Means are provided to see that the air stream which prevents material impaction, does not degrade the operation of the vacuum controlled flow of materials. The material is output to a separator device which separates denser from less-dense materials. In the preferred embodiment disclosed, the apparatus for separating the materials in accord with their density is disclosed as a riffled surface sluice. The riffled surface sluice is itself vibrated in response to the differential pressures established within and without the vacuum chamber. Since those pressures can vary as a result of the amount of material being input to the vacuum chamber, a vacuum responsive frequency control is incorporated in the vacuum responsive vibratory drive of the riffled sluice. This frequency control compensates for variations in the differential pressures within and without the vacuum chamber. The vacuum controlled flow of material from the vacuum chamber to the vacuum driven riffled sluice is disclosed in the preferred embodiment as an output orifice comprised of a flexible sleeve which is deformable so as to close in response to the differential pressures within and without the vacuum chamber but to yieldingly open as a result of the accumulation of material thereon. The exhaust means which provides the region of lowered pressure within the vacuum chamber is disclosed herein as an exhaust fan which is driven by a prime mover disclosed here as an internal combustion engine. The entire device is easily manually transportable and may be fitted to a conventional backpack frame. Convenient support is provided for the drive placer mining apparatus in use in the field by retractable tripod supports.

Those skilled in the art will conceive of other embodiments of the invention which remain within the spirit and scope thereof as provided and disclosed in the appended claims.

Having described my invention in the foregoing specification and the accompanying drawings in such a clear and concise manner that those skilled in the art may readily and simply practice the invention, that which I claim is:

1. Portable dry-placer mining apparatus comprising:

vacuum chamber means defining a contained region of lower-than-atmospheric pressure;

material collection means coupled to said contained region for drawing material into said contained region at a rate determined by the differential pressure within and without the contained region;

material discharge means coupled to said vacuum chamber for discharging material collected in the contained region at a rate controlled by said differential pressure;

separating means into which material is discharged by the material discharge means for separating denser particles from less dense particles of the material;

vacuum actuated vibrating means coupled to said region for vibrating the separating means; and control means responsive to the differential pressure for controlling the frequency of vibration of the vibratory means.

2. Portable dry-placer mining apparatus comprising:

vacuum chamber means defining a contained region of lower-than-atmospheric pressure;

material collection means coupled to said contained region for drawing material into said contained region at a rate determined by the differential pressure within and without the contained region;

material discharge means coupled to said vacuum chamber for discharging material collected in the contained region at a rate controlled by said differential pressure; and impaction disrupting means coupled to said material discharge means for preventing the impaction of said material within said material discharge means.

3. The portable dry-placer mining apparatus of claim 2 wherein said impaction disruption means further comprises means for moving a stream of air through said material for agitating said material as it is being outputted.

4. The portable dry-placer mining apparatus of claim 3 wherein said means for moving a stream of air through said material comprises air vent means approximate said means for outputting said material and coupled to said vacuum chamber means.

5. The portable dry-placer mining apparatus of claim 4 wherein said means for moving a stream of air through said material further comprises means approximate said output means and coupled to said vacuum chamber means for equalizing pressures between said contained region of lower-than-atmospheric pressure and said output means.

6. The portable dry-placer mining apparatus of claim 5 further comprising means accepting the output of said vacuum chamber means for separating denser particles from less-dense particles contained within the material output from said vacuum chamber means.

7. The portable dry-placer mining apparatus of claim 6 further comprising vacuum actuated vibratory means coupled to said vacuum chamber means as an actuation source and to said means for separating denser from less-dense material so as to impart a vibratory motion to said separating means.

8. The portable dry-placer mining apparatus of claim 7 wherein said vacuum actuated vibratory means further comprises means for controlling the frequency of said vibratory motion imparted to said separating means.

9. The portable dry-placer mining apparatus of claim 8 wherein said means for controlling the frequency of vibration of said separating means comprises a vacuum-compensated vibrator frequency control means coupled to said vacuum actuated vibratory means and said vacuum chamber means.

10. The portable dry-placer mining apparatus of claim 9 wherein said means for outputting said material at a differential-pressure-controlled rate comrpises a vacuum-closed output orifice openingly responsive to the accumulation of said material thereon.

11. The portable dry-placer mining apparatus of claim 10 wherein said vacuum chamber means further comprises exhaust means for exhausting air from said contained region.

12. Placer mining apparatus for collecting granular material and for separating the denser material from the less dense material comprising:

a cabinet defining a contained region, said cabinet having end walls and a bottom panel;

filter means for dividing the contained region into a first chamber and a second chamber;

pump means located in the first chamber for producing lower-than-atmospheric pressure in said contained region when energized;

an internal combustion engine mounted on an end wall of said cabinet for energizing said pump means;

a flexible hose connected to said second chamber for delivering granular material into said second chamber;

a drop tube having an upper end in communication with the lower end of the second chamber, a lower end and a valve mounted on the lower end for regulating the flow of materials through the drop tube;

frame means mounted on the cabinet for supporting the cabinet above a surface;

deck means having a surface;

riffles mounted transversely on the surface of said deck means;

means for positioning the deck means so that material flowing through the valve mounted on the drop tube is discharged onto the surface of the deck means;

means energized by being connected to said first compartment for imparting a vibratory motion to said deck means to separate denser particles of the granular material discharged onto the deck from less dense particles as said less dense particles move over said riffles; and a backpack frame attached to said cabinet, whereby said apparatus can be carried by one person.

13. Placer mining apparatus as defined in claim 12 further comprising means for controlling the frequency of vibratory imparted to said deck means.

14. Placer mining apparatus as defined in claim 13 further comprising impaction disruption means mounted on the drop tube for preventing impaction of the granular material in the drop tube.

15. Placer mining apparatus as defined in claim 14 in which the impaction disruption means comprises an air vent formed in the drop tube.

16. Placer mining apparatus as defined in claim 15 in which the flexible hose is provided with a nozzle.

17. Placer mining apparatus as defined in claim 16 in which the frame means includes a tripod.

18. Placer mining apparatus as defined in claim 17 in which the tripod has three legs, the length of each of which is adjustable.

19. Placer mining apparatus as defined in claim 18 in which the means for positioning the deck means are connected to the legs of the tripod.

20. Placer mining apparatus as defined in claim 19 in which the means for positioning the deck means includes chains.

21. Placer mining apparatus as defined in claim 20 in which the granular material is substantially dry.

22. Portable dry-placer mining apparatus comprising:

vacuum chamber means defining a contained region of lower-than-atmospheric pressure;

material collection means coupled to said vacuum chamber means for drawing material into said contained region at a rate determined by the differential pressure within and without the contained region;

separating means coupled to said vacuum chamber means for accepting material drawn into the contained region and for separating denser particles from less dense particles of said materials;

vacuum actuated vibratory means coupled to the vacuum chamber means and to the separating means for imparting a vibratory motion to the separating means; and control means for controlling the frequency of the vibratory motion imparted to the separating means, said control means comprising a vacuum compensated vibrator frequency control means coupled to said vacuum actuated vibratory means and said vacuum chamber means.

23. Portable dry-placer mining apparatus comprising:

vacuum chamber means defining a contained region of lower-than-atmospheric pressure;

material collection means coupled to said vacuum chamber means for drawing material into said contained region at a rate determined by the differential pressure within and without the contained region;

means forming a riffled surface positioned so that material drawn into the contained region is deposited on said means forming a riffled surface;

means coupled to said vacuum chamber means for depositing material on said riffled surface at a rate controlled by said differential pressure;

impaction disruption means coupled to said means for depositing said material for preventing the impaction of said material within said means for for depositing said material; and means for imparting vibratory motion to said means forming a riffled surface to separate denser particles of material from less dense particles as said less dense particles pass over said means forming a riffled surface.

24. The portable dry-placer mining apparatus of claim 23 wherein said impaction disruption means further comprises means for moving a stream of air through said material for agitating said material as it passes through the means for depositing material.

25. The portable dry-placer mining apparatus of claim 24 wherein said means for moving a stream of air through said material comprises air vent means proximate said means for depositing said material and coupled to said vacuum chamber means.

26. The portable dry-placer mining apparatus of claim 25 wherein said means for moving a stream of air through said material further comprises means proximate said means for depositing material and coupled to said vacuum chamber means for equalizing pressures between said contained region of lower-than-atmospheric pressure and said means for depositing material.

* * * * *